United States Patent [19]

Tsai

[11] Patent Number: 4,506,835

[45] Date of Patent: Mar. 26, 1985

[54] OIL SHALE BENEFICIATION

[75] Inventor: Shirley C. Tsai, Irvine, Calif.

[73] Assignee: Occidental Research Corp., Los Angeles, Calif.

[21] Appl. No.: 386,201

[22] Filed: Jun. 7, 1982

Related U.S. Application Data

[63] Continuation-in-part of Ser. No. 375,407, May 6, 1982, abandoned.

[51] Int. Cl.[3] ..... B02C 1/00

[52] U.S. Cl. ..... 241/20; 241/21; 209/3; 209/172.5; 209/166

[58] Field of Search ..... 209/1, 2, 3, 4, 5, 7, 209/8, 9, 12, 10, 13, 166, 167, 172, 172.5; 208/11 R, 11 E; 241/20, 21

[56] References Cited

U.S. PATENT DOCUMENTS

| | | | |
|---|---|---|---|
| 1,961,232 | 6/1934 | Maust et al. | 209/2 |
| 3,061,097 | 10/1962 | Dering | 209/5 |
| 3,268,071 | 8/1966 | Puddington | 209/5 |
| 3,485,356 | 12/1969 | Burr | 209/211 |
| 3,595,386 | 7/1971 | Hradel | 209/8 |
| 4,176,042 | 11/1979 | Fahlstrom . | |
| 4,192,738 | 3/1980 | Columbo et al. | 209/5 |
| 4,257,878 | 3/1981 | Fishback | 209/2 |
| 4,257,879 | 3/1981 | Bogenscheider | 209/1 |
| 4,265,737 | 5/1981 | Smith et al. | 209/3 |
| 4,348,274 | 9/1982 | Guerre | 209/2 |

*Primary Examiner*—Bernard Nozick

*Attorney, Agent, or Firm*—Christie, Parker & Hale

[57] ABSTRACT

There is provided a process for the beneficiation of oil shale comprising comminuting oil shale to a maximum particle size that maximizes the separation efficiency index of a physical separation method at a predetermined product yield. The oil shale particles are then separated into organic-rich product and organic-lean refuse by the physical separation methods in which the product yield is adjusted to maximize the separation efficiency index of the separation. Preferred physical separation methods include gravity separation, hydraulic separation by tabling, froth flotation and oil agglomeration.

4 Claims, 3 Drawing Figures

OIL SHALE BENEFICIATION

This invention is a continuation-in-part of U.S. patent application Ser. No. 375,407 filed May 6, 1982 now abandoned, entitled OIL SHALE BENEFICIATION and incorporated herein by reference.

This invention is also related to U.S. patent application Ser. No. 386,200 now abandoned filed concurrently herewith which is a continuation-in-part of U.S. patent application Ser. No. 375,406 filed May 6, 1982 now abandoned, entitled OIL SHALE BENEFICIATION BY FROTH FLOTATION, both of which are incorporated herein by reference.

BACKGROUND OF THE INVENTION

The process described herein relates to improving the efficiency of an above-ground oil shale retort. More particularly, the process relates to oil shale beneficiation wherein organic-rich oil shale is separated from organic-lean oil shale.

The term "oil shale" as used in the industry refers to a sedimentary formation comprising marlstone deposits with layers containing an organic polymer called "kerogen" which, upon heating, decomposes to produce liquid and gaseous products. The formation containing kerogen is called "oil shale"; herein the liquid hydrocarbonaceous product produced upon decomposition of kerogen is called "shale oil".

The grade of oil shale is commonly stated in units of the quantity of shale oil that can be recovered from the oil shale in a standard retorting test. Most commonly the Fischer Assay is used, wherein a weighed sample of pulverized oil shale is heated in a closed vessel at a specific heating rate. The shale oil distilled is measured and the grade is stated in units such as gallons of shale oil per ton of oil shale. Shale devoid of kerogen produces no shale oil. Kerogen-rich oil shale can produce 70 gallons per ton (gpt) or more.

In above-ground or surface retorts, the retorting process occurs in large metal vessels. Heat supplied to the process may be from direct internal combustion of fuel or from indirect heating of a medium which is then added to the shale. The direct heating method utilizes the combustion of recycled gas or residual carbon in the spent shale with added oxygen or air as the heat source. The indirect heating method uses a furnace or other heating apparatus to heat a solid or gaseous medium which is then introduced into the shale in the retort. Combination processes having both capabilities are also used.

Many methods for shale oil production are described in *Synthetic Fuels Data Handbook,* Second Edition, compiled by Dr. Thomas A. Hendrickson, published by Cameron Engineers, Inc., Denver, Colo. Examples of the abovementioned processes include the N-T-U and Union Oil direct heating processes, the Tosco II indirect heating process and the Paraho process having both capabilities.

The N-T-U process is a batch process as described at page 67 of the *Synthetic Fuels Data Handbook* and the U.S. Patents referred to therein. In the N-T-U process, a retort is filled with a batch of oil shale particles and ignited at the top. Combustion is supported by air injection and a combustion zone is passed downwardly through the stationary bed of shale. A recycle of gas from the bottom of the retort is mixed with the combustion gas to modulate temperatures and provide some of the fuel requirement.

The Tosco II retorting process is described at page 85 of the *Synthetic Fuels Data Handbook* and in U.S. Pat. No. 3,025,223. This process involves preheating oil shale having a particle screen size of 0.5 inch or less to about 500° F. in a fluidized bed. Pyrolysis is completed in a rotating drum heated by ceramic balls which are separately heated in a ball-heating furnace.

The Paraho process is described on page 100 of the *Synthetic Fuels Data Handbook.* The Paraho process employs a vertical kiln through which ground oil shale moves downwardly as gas moves upwardly. Combustion air can be admitted into the bed of oil shale particles for direct heating of oil shale by combustion within the bed. The kiln can also be arranged so that recycled gas can be heated externally, then injected into the bed of oil shale for indirect heating.

Surface retorting processes have the advantage that process parameters are easily controlled whereas in situ retorting process parameters are more difficult and complicated to control. However, surface retorting processes suffer from the disadvantage that large amounts of shale must be mined, transported to the retort facility and retorted in costly retorts. This adds a tremendous expense to surface retorting operations.

Increasing the efficiency of a surface retorting process is extremely desirable. The cost of producing a specific amount of shale oil in a surface retort is dependent upon the volume of raw material that is required to produce that amount of shale oil, which in turn is dependent upon the concentration of organic material in the raw oil shale. By increasing the concentration of organic material in the surface retort, the cost of producing shale oil is reduced.

Roberts and Schaeffer Resource Service, Inc. (RSRS) have disclosed an oil shale beneficiation process using gravity separation in a heavy medium cyclone to separate oil-rich (i.e., high kerogen content) shale from oil-lean shale. The oil-rich shale is passed to a surface retort wherein shale oil is produced and the oil-lean shale is discarded.

While the RSRS beneficiation process improves the efficiency of a surface retort process, it has poor selectivity in separating organic-rich particles from organic-lean particles. Reduction in the cost of producing shale oil is thereby limited by the poor selectivity of this beneficiation process.

SUMMARY OF THE INVENTION

In accordance with the present invention, there is provided a process for the separation of organic-rich oil shale particles from mineral-rich oil shale particles.

The process comprises comminuting oil shale particles to a maximum particle size that maximizes the separation efficiency index of a physical separation method at a predetermined product yield. The comminuted oil shale particles are then separated according to organic content by that physical separation method into product having a higher organic content and refuse having a lower organic content in which the product yield of the physical separation is adjusted to maximize the separation efficiency index.

Preferred physical separation methods include gravity separation, froth flotation, hydraulic separation by tabling, oil agglomeration and combinations of two or more of these methods.

Gravity separation methods utilize a heavy medium having a density greater than organic-rich particles and less than organic-lean particles. Mixing of the heavy medium with the particles results in organic-rich particles floating and organic-lean particles sinking. The preferred maximum particle size of oil shale capable of producing an average of at least 15 gallons of shale oil per ton of oil shale for gravity separation methods is about 0.75 inch screen size and preferably about 0.5 inch screen size. Particles having a screen size of no more than about 200 mesh are preferably removed prior to the physical separation.

Froth flotation involves mixing the crushed oil shale particles with an aerated aqueous solution. The aqueous solution contains a frother which reduces the surface tension of the solution, thereby producing a froth and a collector to facilitate adsorption of air bubbles at the organic-rich surfaces. Air bubbles preferentially adsorb at organic-rich surfaces which have a greater hydrophobic character than mineral-rich surfaces. Adsorbed air bubbles decrease the apparent (or effective) density of the particle and, if the density is decreased sufficiently, will cause these particles to float. The preferred maximum particle size of oil shale capable of producing an average of at least 15 gallons of shale oil per ton of oil shale by weight for froth flotation separation methods is about 16 mesh screen size and preferably from about 32 mesh to 100 mesh screen size.

In hydraulic separation, particles not more than the preferred maximum particle size are separated according to density and particle size wherein coarser and lighter particles are separated from denser and smaller particles by tabling methods. The preferred maximum particle size for oil shale capable of producing an average of at least 15 gallons of shale oil per ton of oil shale for this method is about 0.75 inch screen size and preferably about 0.5 inch. Particles having a screen size of no more than about 200 mesh are preferably removed prior to tabling.

The method of oil agglomeration is preferred for particles having a maximum screen size of no more than 100 mesh. The particles are mixed with a two-phase liquid mixture of organic and aqueous phases. Organic-rich particles form agglomerates in the organic phase and mineral-rich particles form suspensions in the aqueous phase.

The percentage of oil shale particles recovered as product, i.e., the product yield, is adjusted to maximize the separation efficiency index of the particular method of physical separation. Large product yields increase organic recovery but also increase mineral recovery, thereby reducing the efficiency of the process. Small product yields reduce mineral recovery but also reduce the recovery of organic components. It has been found that for raw oil shale feed capable of producing an average of at least 15 gallons of shale oil per ton of oil shale and no more than the maximum preferred particle size, product yields of between 30% and 60% and preferably between 40% and 50% maximize the separation efficiency index, i.e., provide the optimum combination of maximum organic recovery and minimum mineral recovery of gravity separation, froth flotation and hydraulic separation methods. For oil agglomeration methods, product yields of 50% to 90% and preferably from 60% to 80% are preferred.

BRIEF DESCRIPTIONS OF THE DRAWINGS

These and other features and advantages of the present invention will be better understood by reference to the following detailed description when considered in conjunction with the accompanying drawings wherein.

DETAILED DESCRIPTION

Figure 1:
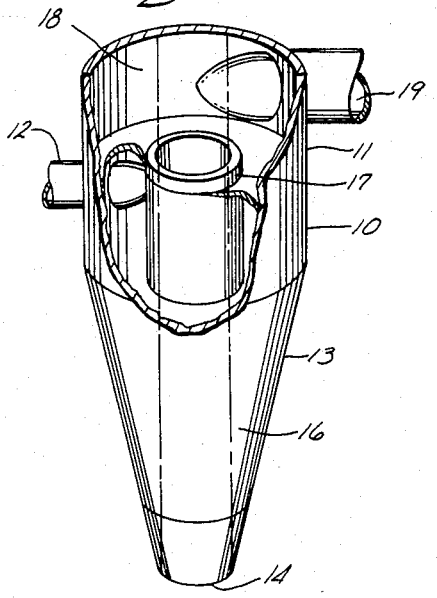
FIG. 1 is a partially cutaway sectional view of a heavy medium cyclone.

There is provided a process for the beneficiation of oil shale in which organic-rich oil shale is separated from organic-lean oil shale. The process comprises comminuting oil shale to a selected maximum particle size followed by physically separating organic-rich particles from organic-lean particles. The process increases the efficiency of conventional methods used for physically separating oil shale particles based on organic content.

Coarse oil shale feed is first comminuted to a select maximum particle size. Comminution of oil shale particles may be in an open loop system or in a closed loop system. In an open loop system, the feed is comminuted, e.g., crushed and/or ground, until the coarsest particle size corresponds to the maximum particle size desired. In a closed loop system, the oil shale feed is comminuted until the coarsest particles have a selected size which is larger than the desired maximum particle size. Particles less than or equal to the desired maximum particle size are then separated and removed. Additional feed is added and the sequence is repeated on the oversize particles. Closed loop comminution minimizes excess production of undersize particles.

Comminuted oil shale particles are then separated according to organic content into product, having a higher organic content, and refuse, having a lower organic content. Refuse is subsequently sent to disposal or processed differently from the organic-rich product.

Oil shale has a unique laminar structure comprising layers ranging from high organic content to low or essentially no organic content. After comminution, the organic content of particles ranges from a very high organic content to essentially no organic content.

Physical separation of minerals from gangue in conventional mineral ores typically involves grinding the ores to a particle size sufficiently small to substantially completely liberate the desired mineral from the gangue. A subsequent physical separation thus yields a product, having a very high percentage of the desired mineral, and refuse, having a very low percentage of the desired mineral. In other words, the liberation of the desired mineral is so complete that it enables a very high recovery of the mineral and at the same time a very high rejection of the gangue.

Unlike conventional mineral ores, the structure of oil shale prevents the complete liberation of organic particles from mineral particles without great expense. This is due to the fact that the grain size of oil shale, i.e., the particle size in which discrete organic particles and mineral particles are found, is much smaller than the corresponding grain size of conventional mineral ores. In addition, oil shale tends to resist breakage during grinding. This results from the organic components of oil shale particles imparting an elastomeric quality to the particles. Oil shale particles tend to be "rubbery" and will deform before breaking. As the particle size of oil shale is reduced, further reduction becomes increasingly difficult.

Because there is no practical method to comminute oil shale to completely liberate organic particles, a new approach must be taken. The present invention provides a method for determining the maximum particle size that a particular oil shale feed should be comminuted to in order to maximize the organic recovery and mineral rejection in a subsequent physical separation.

The maximum particle size, which is greater than the particle size necessary to completely liberate organic and mineral particles, is chosen to achieve the maximum separation efficiency index of the subsequent physical separation at a predetermined product yield. The maximum particle size for oil shale feed depends on the method of the physical separation of organic-rich particles from mineral-rich particles and on the amount and dispersion of organic component in the oil shale feed.

As used herein, "product yield" refers to the percentage of the feed to the physical separation that is recovered as product. For example, if 100 pounds of oil shale were introduced to the physical separation and 40 pounds of the higher grade particles were recovered as product, the product yield would be 40%.

As used herein, "separation efficiency index" is defined as the percent organic recovery multiplied by the percent mineral rejection and divided by 100.

Percent organic recovery is the percentage of the organic content of the product multiplied by the product yield and divided by the percentage of the organic content of the oil shale feed introduced to the physical separation. For example, if the product yield of the physical separation were 50%, the organic content of the product were 25% by weight and the average organic content of the oil shale feed were 15% by weight, the percent organic recovery would be about 83.

The percent mineral rejection is equal to one hundred minus the result of the percentage of the mineral content of the product multiplied by the product yield and divided by the percentage of the mineral content of the oil shale feed. In the above example, the percentage of the mineral content of the product would be 75. This, multiplied by a percent product yield of 50 and divided by the percentage of the mineral content in the feed, which would be 85, would generate a result of about 44. This result subtracted from 100 would give a percent mineral rejection of about 56. In this example, the separation efficiency index would be the product of 83 multiplied by 56 and divided by 100, or about 46.5.

A separation efficiency index of 100 would indicate that all of the organic component was recovered and all of the mineral component was rejected. However, a separation efficiency index of 100 is not possible. In order to liberate the organic component completely from the mineral components, the oil shale would require comminution to a size too small to be effectively separated by, for example, froth flotation. The maximum separation efficiency index is thus dependent on the average organic content of the oil shale, the dispersal of the organic and mineral components throughout the oil shale and the method of the physical separation.

As used herein, "to maximize" the separation efficiency index means that the process parameters are adjusted to generate a separation efficiency index within about 5 separation efficiency index units of the maximum as determined experimentally.

For example, if the maximum separation efficiency index, as determined experimentally, was 50.0, the process parameters would be "maximized" if they are adjusted to generate a separation efficiency index of at least 45.0.

To determine the maximum separation efficiency index experimentally, the desired maximum particle size is first determined by performing test separations which generate a constant product yield for feeds having a constant organic content but varying maximum particle sizes. The products of such test separations are analyzed and the separation efficiency indices calculated. The desired maximum particle size corresponds to the maximum separation efficiency index and can be interpolated from a few tests.

It is presently preferred that the predetermined product yield be in the range of about 30% to about 60% as product yields in this range tend to maximize the separation efficiency index for most oil shale feed, i.e., oil shale capable of producing an average of at least 15 gallons of shale oil per ton of oil shale, i.e., having an average organic content of at least about 9% by weight.

Test separations are again made wherein the parameters of the physical separation are adjusted to achieve varying product yields. Each product is analyzed and the separation efficiency index of each separation calculated. The process parameters of the physical separation are then adjusted according to the test separation results to achieve a product yield which maximizes the separation efficiency index of the separation.

The optimum product yield for maximizing the separation efficiency index is also found by interpolating from a few tests. If desired, the technique can be further refined by repeating the tests for determining maximum particle size with the determined optimum product yield and then repeating the determination of optimum product yield if the maximum particle size is significantly different from the maximum particle size determined in the first series of tests.

It has been found that large product yields tend to be undesirable because the total amount of organic components recovered is maximized, the mineral content of the product is also increased. Small product yields which minimize the mineral content of the product also tend to be undesirable because the total amount of organic components that are recovered is reduced.

The oil shale is then comminuted to the predetermined maximum particle size, and the comminuted oil shale particles are physically separated into product and refuse wherein the product consists generally of organic-rich particles and the refuse consists generally of mineral-rich particles, i.e., organic-lean particles.

Preferred methods for physically separating oil shale particles according to organic content include gravity separation methods, froth flotation methods, hydraulic separation methods, e.g., by tabling, oil agglomeration methods and combinations of two or more of these methods.

Gravity separation methods are based on the difference in density between the organic component and the mineral components of oil shale. The density of the organic component is generally between 1.1 and 1.2 while the densities of the mineral components vary; about 2.7 for quartz, about 2.9 for dolomite, about 2.2 for analcite, and about 5.0 for pyrite. Other mineral species that may be present include nahcolite and dawsonite.

A preferred method for gravity separation is by heavy medium separation. Heavy medium separation involves mixing the particles with a heavy liquid medium. The heavy medium has a density greater than organic-rich particles but less than organic-lean particles. Separation is achieved as organic-rich particles float and mineral-rich particles sink. The presently preferred heavy media are zinc chloride solution and finely-ground magnetite suspended in water, both having a specific gravity generally around 2.0. The specific gravity of the heavy medium is adjusted to generate the desired product yield.

In gravity separation methods using a heavy medium, it has been found that the preferred maximum particle size for oil shale capable of producing an average of at least 15 gallons of shale oil per ton of oil shale is about 0.75 inch and preferably about 0.5 inch. Particles larger than the maximum particle size tend to retain the general composition of the coarse oil shale feed and therefore display very little variation in organic content between particles. That is, particles having a screen size greater than 0.75 inch exhibit significantly less separation of organic components and mineral components than particles less than 0.75 inch and therefore increase the mineral content of the product if included in the product or decrease the organic content of the product if excluded. Particles having a screen size in the range from 200 mesh to 0.5 inches generate the greatest separation efficiency indices in the heavy medium separation for a particular product yield.

At least a portion of the particles having a screen size of no more than about 200 mesh are preferably removed, e.g., by screening, prior to the physical separation. Particles of no more than about 200 mesh display good separation of organic components and mineral components into discrete particles, i.e., particles less than 200 mesh tend to be either organic-rich or mineral-rich. However, particles having a screen size smaller than about 200 mesh are not preferred because they tend to increase the mineral content of the product. That is, the selectivity of the gravity separation methods decreases for particles smaller than about 200 mesh.

It has further been found that, for particles of no more than the preferred maximum particle size, the highest separation indices are achieved at product yields of 30% to 60% and preferably from 40% to 50%.

With reference to FIG. 1, a preferred apparatus for heavy medium separation is a heavy medium cyclone. A heavy medium cyclone comprises a cylindroconical unit 10 having a cone angle of approximately 20°. A mixture of feed particles having a select maximum particle size and a heavy medium is introduced tangentially into the cylindrical section 11 of the unit through a feed inlet 12 at a rapid speed. A vortex is created with a central air core 16 due to the induced rotational force. Heavy, organic-lean particles move farthest from the central axis of the unit due to the centrifugal force and downward into the conical section 13 and out the cyclone apex 14 as refuse. Light, organic-rich particles align closer to the central axis of the unit and move to the central air core 16, and then pass upward through a vortex finder 17 into an overflow chamber 18, and are discharged through a tangential outlet 19 as float, i.e., product.

Figure 2:
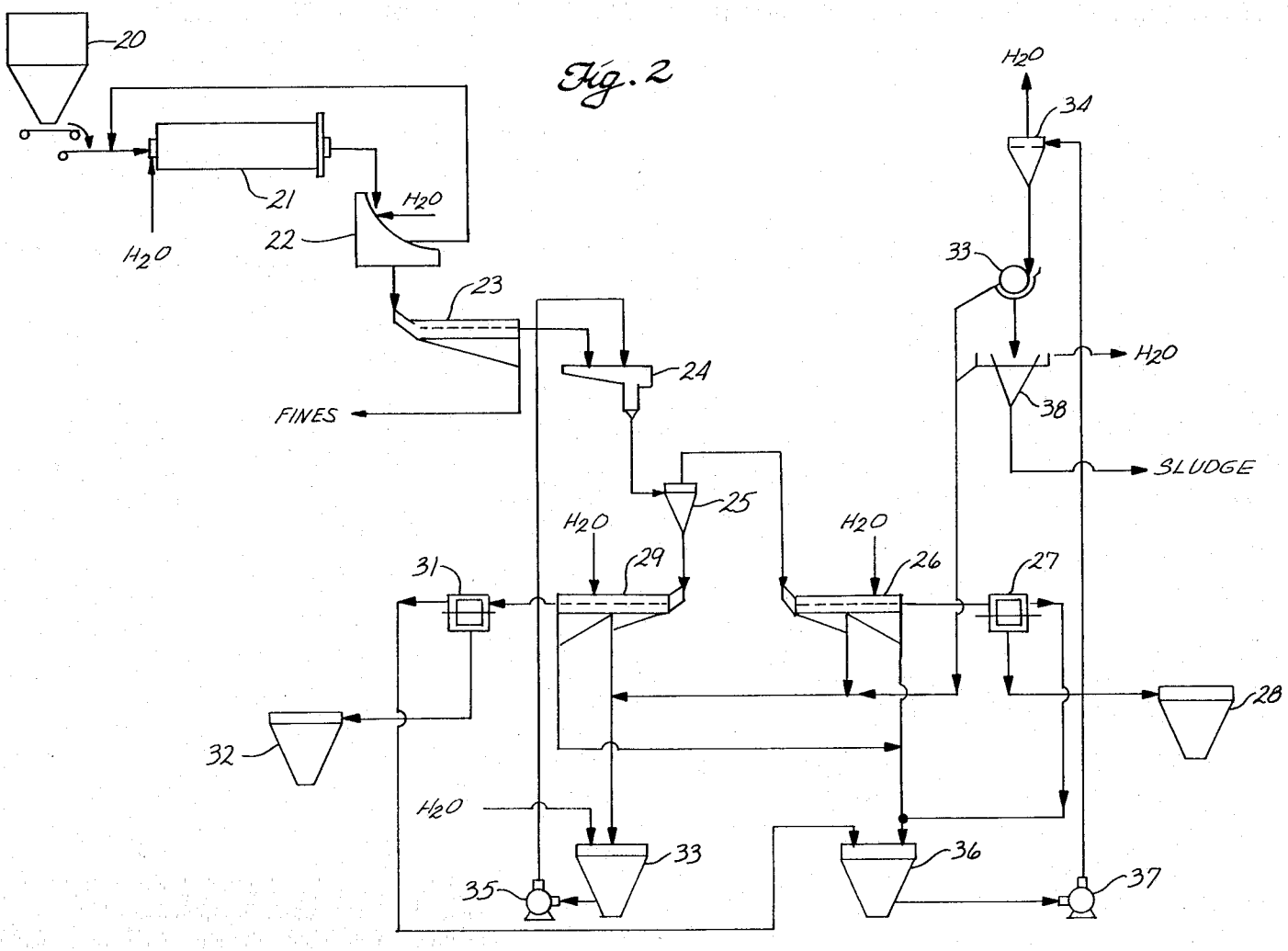
FIG. 2 is a flow diagram of a preferred oil shale beneficiation process using heavy medium gravity separation.

A preferred process for the beneficiation of oil shale using a heavy medium cyclone is shown in FIG. 2. Coarse raw oil shale is crushed at the excavation site and screened to reject particles over about 0.75 inch screen size. The particles are then introduced to shale surge hopper 20 and then passed to a rod mill 21 in which the oil shale is wet milled. The ground shale is then passed through a water screen 22 and a desliming screen 23 to remove fines which are essentially clay and minerals with very little organic content. The shale is then introduced into a pulping tank 24 where it is mixed with a heavy medium. The heavy medium used in this process is an aqueous mechanical suspension of finely ground magnetite with a specific gravity of about 2.0.

The resulting mixture from the pulping tank 24 is introduced into a heavy medium cyclone 25 for separation. The cyclone overflow (float) which contains the oil-rich shale fraction along with most of the magnetic fines is discharged over a draining and rinsing screen 26 for separation of the heavy medium. Water is added to facilitate the separation. The organic-rich fraction is passed to a centrifuge 27 for water removal and then collected as product in a product tank 28. The product is then passed to above-ground retorts.

The cyclone underflow which contains the denser mineral-rich shale fraction is also discharged into a draining and rising screen 29 to recover the heavy medium. The mineral-rich fraction is also passed to a centrifuge 31 for water removal and the solids collected in a refuse tank 32 and subsequently disposed of.

The initial underflow from the draining screen 26 and 29 is sent to a heavy medium sump 33 for specific gravity adjustment and recycled by pump 35 to the pumping tank 24. The dilute rinsed heavy medium from the latter sections of draining screen 26 and 29 is sent to a dilute heavy medium sump 36 and then pumped by pump 37 through a densifier cyclone 34 and passed over magnetic separators 33 to recover the heavy medium. The rinse water containing non-magnetic fines is sent to a cone settler 38 to recover water for recycle and the sludge is sent to disposal. The medium recovered from the magnetic separations is sent to the heavy medium sump 33 for specific gravity adjustment and recycle to the pulping tank 24.

Separations by froth flotation method are based on the difference in the surface properties and densities between organic-rich particles and mineral-rich particles. Organic-rich particles have greater hydrophobic properties than mineral-rich particles, which have greater hydrophilic properties. This is a result of the organic component kerogen which comprises large, substantially non-polar hydrophobic compounds.

When immersed in an aerated aqueous solution, the organic-rich particles have a greater affinity for the selective adsorption of air bubbles at their surface than mineral-rich particles. Adsorption of air bubbles reduces the overall density of the particle and if the overall density is reduced sufficiently, the particle floats. In addition, the density of organic-rich particles is lower than the density of mineral-rich particles and therefore organic-rich particles are more easily floated than mineral-rich particles. The froth therefore selectively comprises organic-rich particles and is collected as product.

The aqueous solution comprises a frother or frothing agent to generate a froth, i.e., to prevent the bubbles from bursting at the solution surface, and therefore maintain the floated particles at the surface of the solution. The solution further comprises a collector which selectively coats the organic-rich particles and increases the affinity of the organic-rich particles to air bubbles.

The product yields can be adjusted by adjusting the concentrations of the frother and the collector.

It has been found that, for oil shale capable of producing an average of at least 15 gallons of shale oil per ton of oil shale, the maximum separation efficiency indices at a predetermined product yield are obtained with particles having a maximum particle size of about 16 mesh, and preferably of about 32 mesh. For such particles, product yields of from about 30% to about 60% and preferably from about 40% to about 50% maximize the separation efficiency index for froth flotation.

Particles having a screen size larger than 16 mesh are not preferred because the weight of these particles makes them significantly more difficult to float and therefore organic-rich particles tend to be rejected, resulting in a lower separation efficiency index.

It is also preferred that at least a portion of the particles having a screen size of less than about 200 mesh, and preferably less than about 100 mesh, are removed prior to separation by froth flotation. Particles having a screen size less than 200 mesh are not preferred because mineral-rich particles of this size tend to float and therefore increase the mineral content of the product. In other words, froth flotation separation tends to be nonselective for particles less than about 200 mesh.

Froth flotation methods show the greatest separation of organic-rich particles from mineral-rich particles when the particles have a screen size from about 100 mesh to about 32 mesh.

Another preferred method of separation according to organic content is hydraulic separation by tabling. This method of separation is based on particle density and particle size.

For particles of no more than the maximum size, the larger particles tend to contain a larger average organic content than smaller particles. This is because the organic component, i.e., kerogen, is more difficult to comminute than the mineral components in oil shale. When ground, the mineral layers of oil shale tend to break into smaller particles whereas the organic layers, which are more resistant to breakage, tend to form larger particles.

For oil shale capable of producing an average of at least 15 gallons of shale oil per ton of oil shale, the preferred maximum particle size for hydraulic separation by tabling is about 0.75 inch screen size, and preferably about 0.5 inch screen size. Particles having a screen size greater than 0.75 inch display insufficient separation of organic and mineral components and therefore lower the separation efficiency index. Particles having a screen size of no more than about 0.5 inch exhibit the highest separation efficiency indices for a select product yield.

Figure 3:
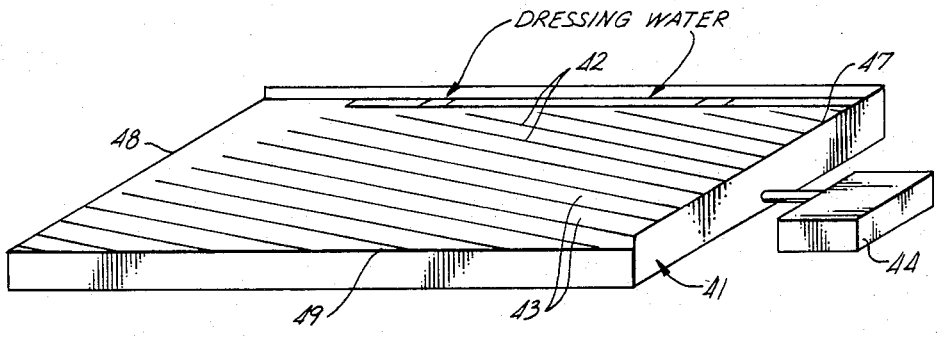
FIG. 3 is a schematic view of a hydraulic separation table.

With reference to FIG. 3, hydraulic separation by tabling involves the use of a sloped deck 41 having a series of alternating riffles 42 and troughs 43. A differential motion drive 44 gives the deck a reciprocating motion along the long axis of the deck. Dressing water is introduced and flows in the direction of the sloped short axis, perpendicular to the motion of the deck. Oil shale particles are introduced to the deck at the upper corner 47 of the long diagonal of the deck and form a bed of particles. The particles become stratified from the top of the bed to the bottom in order of increasing density. The stratified material in the troughs 43 is acted upon by the reciprocating motion of the deck to a greater extent at the bottom of the bed than at the surface. The bottom layer generally consists of the finest and heaviest particles. These move faster to the discharge end 48 of the deck than the coarser and lighter particles. The coarser and lighter particles, which are generally at the top of the particle bed, move with the dressing water, generally perpendicular to the long axis of the deck. Organic-rich particles are recovered as product along a select length of the product end 49 of the deck.

The product yield is adjusted by adjusting the length along the product end 49 of the deck in which particles are recovered as product to achieve the desired product yield. The distance between the length along the product end in which particles are recovered and the discharge end of the deck is maximized in order to minimize mineral-rich particle recovery.

For particles of no more than the maximum particle size, product yields of from about 30% to about 60%, and preferably from about 40% to about 50%, maximize the separation efficiency.

The method of oil agglomeration is presently preferred for oil shale particles having a screen size less than about 200 mesh and is effective for particles of less than 100 mesh screen size. For these particles, oil agglomeration demonstrates the greatest selectivity in the separation of organic-rich particles from mineral-rich particles. The method is based on the difference in surface properties between organic-rich particles and mineral-rich particles.

Oil agglomeration comprises mixing oil shale particles with a two-phase liquid mixture of water and a hydrocarbon liquid. Organic-rich particles of no more than the desired particle size tend to agglomerate in the organic phase. Mineral-rich particles do not agglomerate in either phase but tend to form a suspension in the aqueous phase.

Mixing is vigorous and for a sufficient time for the oil-rich particles to form agglomerates in the organic phase and for the mineral-rich particles to form a suspension in the aqueous phase. The size of the agglomerates that are formed is generally from about 1 mm to about 10 mm. The product is then separated from the refuse, e.g., by screening.

Generally the organic phase comprises about 10 percent to about 30% by volume of the two-phase mixture. The liquid to solid ratio is generally from about 2:1 to about 6:1 and preferably about 4:1. The presently preferred organic liquids are refined shale oil and kerosene. A mixture can be used to generate a desired viscosity in the organic phase.

For particles having a maximum particle size of about 100 mesh, the separation efficiency index is maximized at product yields of from about 50% to about 90% and preferably from about 60% to about 80%.

Particles having a screen size greater than 100 mesh are not preferred because organic-rich particles of such a larger size have a lesser tendency to form agglomerates.

A preferred method of oil agglomeration involves wet milling oil shale particles in a ball mill or the like wherein the liquid phase comprises a two-phase liquid mixture of water and a hydrocarbon liquid. The milling reduces the size of the particles and therefore makes the method applicable to particles having a size larger than 100 mesh. During the milling operation, organic-rich particles form agglomerates in the organic phase and mineral-rich particles tend to form suspensions in the aqueous phase.

Milling is performed for a period sufficient to form organic-rich agglomerates. During this period, mineral-rich particles are generally reduced in size, which increases the efficiency of screening as a method for separating refuse from product.

Due to the size reduction occurring in the milling process, particles larger than 100 mesh may be introduced to the mill. However, because of the lubricating properties of the organic phase of the liquid mixture, particles size reduction occurs slowly. For large particles, reduction to a size wherein agglomeration occurs may not occur without excessively long milling times.

Problems associated in reducing the size of particles larger than 100 mesh can be overcome by reducing or eliminating the organic phase of the milling liquid until such time as the particle size reduction has occurred and then adding the organic phase in an amount sufficient for the organic-rich particles to form agglomerates.

A particularly preferred embodiment of this invention involves the combined use of gravity separation, froth flotation and oil agglomeration methods. In this embodiment, raw oil shale is crushed to reduce particle size. The particles are then separated according to size into four groups: a first group having a size range from about 0.5 inch to about 60 mesh; a second group having a size range from about 60 mesh to about 100 mesh; a third group having a size range of less than about 100 mesh; and a fourth group not within any of the first three groups, i.e., having a size range greater than about 0.5 inch.

The first group is separated into product and refuse by heavy medium gravity separation as previously described. The second group is separated into product and refuse by froth flotation and the third group is separated into product and refuse by oil agglomeration as previously described. The fourth group is recycled for additional crushing, wherein the particles are then introduced into one of the first three groups.

The products for all three separation methods are then passed to further processing, e.g., to an aboveground retort for conversion into shale oil.

What is claimed is:

1. A process for oil shale beneficiation comprising:

comminuting oil shale capable of producing an average of at least about 15 gallons of shale oil per ton of oil shale to maximum particle size of about 0.75 inch;

removing at least a portion of comminuted oil shale having a particle size of less than about 100 mesh;

mixing the removed particles having a screen size of less than about 100 mesh with a two phase liquid mixture comprising a hydrocarbon liquid for agglomerating oil-rich oil shale particles in the hydrocarbon phase;

separating the agglomerates into a first oil shale product and refuse wherein the first oil shale product yield has been adjusted to maximize the separation efficiency index of the oil agglomeration separation; and separating the remaining portion of the comminuted oil shale having a particle size greater than about 100 mesh into a second oil shale product and refuse by mixing the comminuted oil shale with a heavy medium having a specific gravity between the specific gravities of the second oil shale product and the refuse, the specific gravity of the heavy medium being sufficient to generate a second oil shale product yield of between about 30% and 60% which maximizes the separation efficiency index.

2. A process as claimed in claim 1 comprising comminuting the oil shale to a maximum particle size of about 0.5 inch.

3. A process as claimed in claim 1 wherein the second oil shale product yield of the heavy medium separation is from about 40% to 50%.

4. A process for oil shale beneficiation comprising:

comminuting oil shale to a maximum particle size of about 0.75 inch;

removing at least a portion of the oil shale particles having a screen size of less than about 100 mesh;

mixing the removed particles having a screen size of less than about 100 mesh with a two phase liquid mixture comprising a hydrocarbon liquid for agglomerating oil-rich shale particles in the hydrocarbon phase;

separating the agglomerates from refuse wherein the oil shale product yield has been adjusted to maximize the separation efficiency index of the oil agglomeration separation;

separating the remaining portion of the comminuted oil shale having a particle size greater than about 100 mesh into a first group comprising particles having a screen size of from about 0.75 inch to about 60 mesh, and a second group comprising particles having a screen size of less than about 60 mesh;

separating the first group into a first oil shale product and refuse by gravity separation in which the first oil shale product yield has been adjusted to maximize the separation efficiency index of the gravity separation; and separating the second group into a second oil shale product and refuse by froth flotation in which the second oil shale product yield has been adjusted to maximize the separation efficiency index of the froth flotation separation.

* * * * *